United States Patent [19]

Larson

[11] 4,129,231

[45] Dec. 12, 1978

[54] PORTABLE, HAND-HELD GUN FOR DISPENSING MULTIPLE FLUIDIC COMPONENTS TO A MIXER

[75] Inventor: Charles L. Larson, Grants Pass, Oreg.

[73] Assignee: Jeddeloh Bros. Sweed Mills, Inc., Gold Hill, Oreg.

[21] Appl. No.: 631,714

[22] Filed: Nov. 13, 1975

[51] Int. Cl.[2] ..... B05B 7/04

[52] U.S. Cl. ..... 222/145; 222/148; 239/414; 239/527; 251/9

[58] Field of Search ..... 222/148, 145; 251/7, 251/9; 239/414, 527

[56] References Cited

U.S. PATENT DOCUMENTS

| | | | |
|---|---|---|---|
| 1,261,986 | 4/1918 | White | 222/148 X |
| 1,686,004 | 10/1928 | Hottinger | 239/414 X |
| 2,356,865 | 8/1944 | Mason | 251/9 X |
| 2,584,178 | 2/1952 | Abbott et al. | 251/7 X |
| 3,105,745 | 10/1963 | Vieli | 251/9 |
| 3,236,419 | 2/1966 | DeRemer et al. | 257/7 X |
| 3,437,273 | 4/1969 | Hagfors | 239/414 |
| 3,559,890 | 2/1971 | Brooks et al. | 239/527 X |
| 3,638,681 | 2/1972 | Moore et al. | 251/9 X |

FOREIGN PATENT DOCUMENTS

| | | | |
|---|---|---|---|
| 543325 | 2/1932 | Fed. Rep. of Germany | 251/9 |

*Primary Examiner*—Robert B. Reeves
*Assistant Examiner*—Frederick R. Handren
*Attorney, Agent, or Firm*—Kolisch, Hartwell, Dickinson & Stuart

[57] ABSTRACT

A readily disassemblable gun for dispensing multiple fluidic components to a mixer includes a handle having an upper barrel. A head asembly is detachably connected to a rear end of the barrel. The head assembly extends flexible, fluid transporting tubes to a forward portion of the barrel and a detachable cap is secured to the forward end for defining an initial mixing chamber between the extended ends of the tubes and a conduit extending from the cap. Fluid components to be mixed are introduced from a supply source through individual tube communicating passages in the head assembly through the tubes to the initial mixing chamber. After initial mixing, the fluidic components are dispensed into an elongate mixer for additional mixing and ultimate discharge. A trigger lever is mounted on the handle and includes a member which normally deforms the tubes for preventing flow of fluidic components therethrough and into the initial mixing chamber. The trigger lever, upon being depressed, moves the member from a tube contacting position to a nontube contacting position thereby permitting the fluidic components to be introduced to the initial mixing chamber. The head assembly, handle and barrel and the cap are all readily disassemblable so that the tubes may be quickly removed from the head assembly and cleaned or replaced. Additionally, a further tube is disposed above the fluidic transpoting tubes for selectively discharging a cleaning solvent into the mixing chamber.

3 Claims, 3 Drawing Figures

PORTABLE, HAND-HELD GUN FOR DISPENSING MULTIPLE FLUIDIC COMPONENTS TO A MIXER

BACKGROUND OF THE INVENTION

A. Field of the Invention

The present invention pertains to dispensing guns, and more particularly, to a readily disassemblable fluid dispensing gun which mixes fluidic components. The dispensing gun employs flexible, fluid transporting tubes which may be quickly replaced or cleaned.

In many manufacturing processes, and specifically in the wood products industry, it is often desirable to mix fluidic materials in order to form putties or glues. For instance, in plywood manufacture, it is desirable to fill knotholes and other defects in the surface of plywood panels with a mixture of resin and catalyst. After a knothole or defect is filled, the plywood surface may be planed or sanded in order to provide a smooth finish. In order to mix resin and catalyst, a device must be provided which sufficiently comingles the materials for delivery through a mixing tube for eventual discharge into a knothole or defect.

Resin and catalyst, when comingled, form a mix which sets up or hardens quite rapidly. Thus, it becomes apparent that when resin and catalyst are to be mixed, the residue must be quickly cleaned from the inside of a dispensing unit if the unit is not to become jammed or clogged. While fluidic dispensing guns are known in the art, a typical defect in these guns is the lack of readily disassemblable components which enable fluidic transporting tubes to be quickly cleaned or replaced.

The present invention contemplates a novel dispensing gun which may be readily disassembled so that fluidic transporting tubes can be replaced or cleaned. Specifically, the present invention provides for a portable, hand-held dispensing gun which includes a handle portion with an upper barrel to which a head assembly is detachably secured at a rear portion thereof. The head assembly extends flexible, fluid transporting tubes through the barrel to a front portion thereof. A cap is detachably secured to the front portion of the barrel for forming an initial mixing chamber. Disposed outwardly from the cap is an elongate tube which may contain a static mixer or the like. Fluidic components to be mixed are introduced from a supply source through hoses to the head assembly and through passages in the head assembly for delivery through tubes to the initial mixing chamber. In order for fluidic components to travel through the tubes, a trigger having a member which normally deforms the tubes to restrict flow therethrough is movable to a nontube contacting position to permit fluid flow therethrough. Disposed adjacent to the fluidic transporting tubes is a solvent tube which will permit the metered passage of solvent to the initial mixing chamber and outwardly through the elongate conduit when a valve is opened to remove resin-catalyst residue.

B. Description of the Prior Art

Guns for dispensing fluidic materials or sprays are well known in the art. For example, in U.S. Pat. No. 2,584,178 there is disclosed a spray gun adapted for spraying a mixture of a liquid or liquids and a gas or gases under pressure onto a surface or an article, whereby to coat or impregnate same. The gun disclosed in this patent is directed to simultaneously spraying two fluids which are maintained in an unmixed condition until they are discharged from the spray nozzle of the gun, whereby the fluids then mix in midair prior to impinging upon a surface or an article. The gun incorporates a lever arm pivotally connected to the gun body to move a further lever arm against a spring biased jaw. As the lever arm is depressed, the spring biased jaw is moved to permit fluids to flow through a plurality of conduits. When the lever is released, the spring biased jaws are moved upwardly against the conduits to deform same and restrict fluid flow therethrough. It is to be specifically noted that the fluids transported through the conduits do not mix until they are passed outwardly through a forwardly arranged nozzle. Furthermore, it is to be noted that the conduits are not readily removable from the gun supporting structure, and there is no provision for a cleaning conduit.

Another prior art spray gun is described in U.S. Pat. No. 2,619,386 and includes a gun adapted to spray two solutions simultaneously. The gun is connected to a source of fluid supply by flexible rubber hoses. A spring biased trigger normally urges a crossbar to a deforming contact position with the flexible rubber hoses to compress same for preventing fluid flow therethrough. Upon depressing the handle actuatable trigger, the crossbar is released from compressing the hoses. Fluid may then flow through the hoses for dispensing outwardly from a nozzle head.

U.S. Pat. No. 2,335,528 sets forth a method of treating lumber in which a means for introducing material under pressure into a recess in the lumber is described. A supply of liquid glue or other cementitious material is disposed above the lumber in an inclined reservoir. A conduit depends from the reservoir to a device which permits the glue under pressure to be discharged into a knothole or other defect. While this patent generally describes a method for treating lumber, the reservoir and trigger valve associated therewith are not portable and furthermore the device does not permit comingling of fluidic materials.

An apparatus for applying putty is disclosed in U.S. Pat. No. 3,775,016. A hand-held troweling tool for applying putty to a workpiece includes a handle and a head assembly secured to the handle. A compressible tube through which putty may be supplied to a cavity in the handle opens into the cavity. A trigger lever on the handle is operable to remove a biasing force against the tube to permit putty flow.

A last prior art device to be considered as being relevant to the present invention is U.S. Pat. No. 3,195,170. Here, there is described a liquid supply system in which an apparatus is designed to supply paint or the like to rollers or brushes. A lever is pivotally connected to a handle through which handle extends a flexible tube from a source of paint. The handle is normally biased against the flexible tube to deform same thereby preventing the flow of paint therethrough. Upon depressing the handle against the spring bias, the tube or hose is permitted to allow paint or the like to flow therethrough to the brushes. It is readily apparent that the tubes and hoses described in this patent are not readily replaceable and furthermore no gun structure is disclosed.

SUMMARY OF THE INVENTION

The present invention provides a portable hand-held fluid dispensing gun which is readily disassemblable for cleaning and repair. The gun includes a handle having a barrel portion through which extend flexible fluid transporting tubes. The tubes are connected at one end to a head assembly which is releasably secured to a rear portion of the barrel. The extending tubes are enclosed within the barrel structure by means of a cap which is threadedly secured to a front portion of the barrel. The threaded cap forms an initial comingling chamber adjacent the end portion of the tubes. After initial comingling, fluid is transported outwardly through an elongate conduit for discharge onto a piece of lumber or other article for coating same. The handle includes a movable trigger lever having a member which normally deforms the flexible tubes to prevent fluid flow therethrough. Upon depressing the trigger lever, the member is moved to a nontube contacting position to permit fluid flow through the tubes. Additionally, a solvent tube is arranged for dispensing solvent into the initial comingling chamber for cleaning same.

It is a general object of the present invention to provide a dispensing gun which will comingle fluidic material in an initial mixing chamber before dispensing the materials into an elongate conduit for eventual discharge onto lumber or articles to be treated with the mixed fluidic materials.

Another object of the present invention is to provide a readily disassemblable dispensing gun in which component parts may be quickly disconnected so that fluidic transporting tubes may be replaced or cleaned.

Another object of the present invention is to provide a portable dispensing gun in which flexible, fluid transporting tubes are arranged to be deformed by a contacting member on a trigger lever so that fluids may not flow therethrough. Furthermore, the trigger is to be arranged so that upon depressing of same, the flexible tubes will return to an open unrestricted fluid flow configuration.

Yet another object of the present invention is to provide a portable readily disassemblable dispensing gun which incorporates an internal tube arranged to pass solvent or the like therethrough for cleaning residue in the initial comingling or mixing chamber.

Still another object of the present invention is to provide a readily disassembleable portable dispensing gun which may be appropriately used with static mixers in elongate tubes, and more particularly a mixer as described in applicant's U.S. Pat. No. 4,034,964.

Additional objects of the present invention reside in the specific construction of the exemplary dispensing gun hereinafter particularly described in the specification and shown in the several drawings.

BRIEF DESCRIPTION OF THE DRAWINGS

Novel features of the improved mixing and dispensing gun in accordance with the present invention will be more readily understood from a consideration of the following description taken together with the accompanying drawings, in which a preferred adaptation is illustrated with the various parts thereof identified by suitable reference characters in each of the views, and in which.

DETAILED DESCRIPTION OF THE INVENTION

Figure 3:
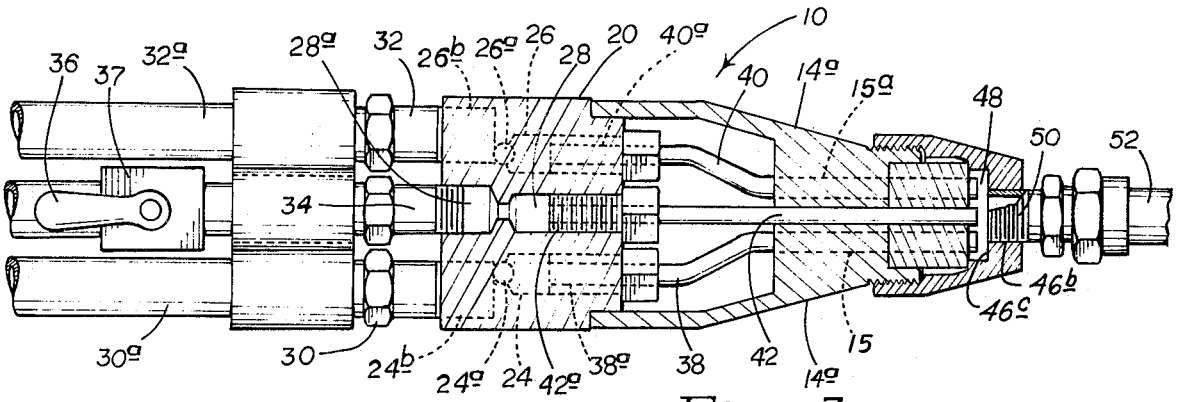
FIG. 3 is a view taken along line 3—3 of FIG. 2.
Figure 2:
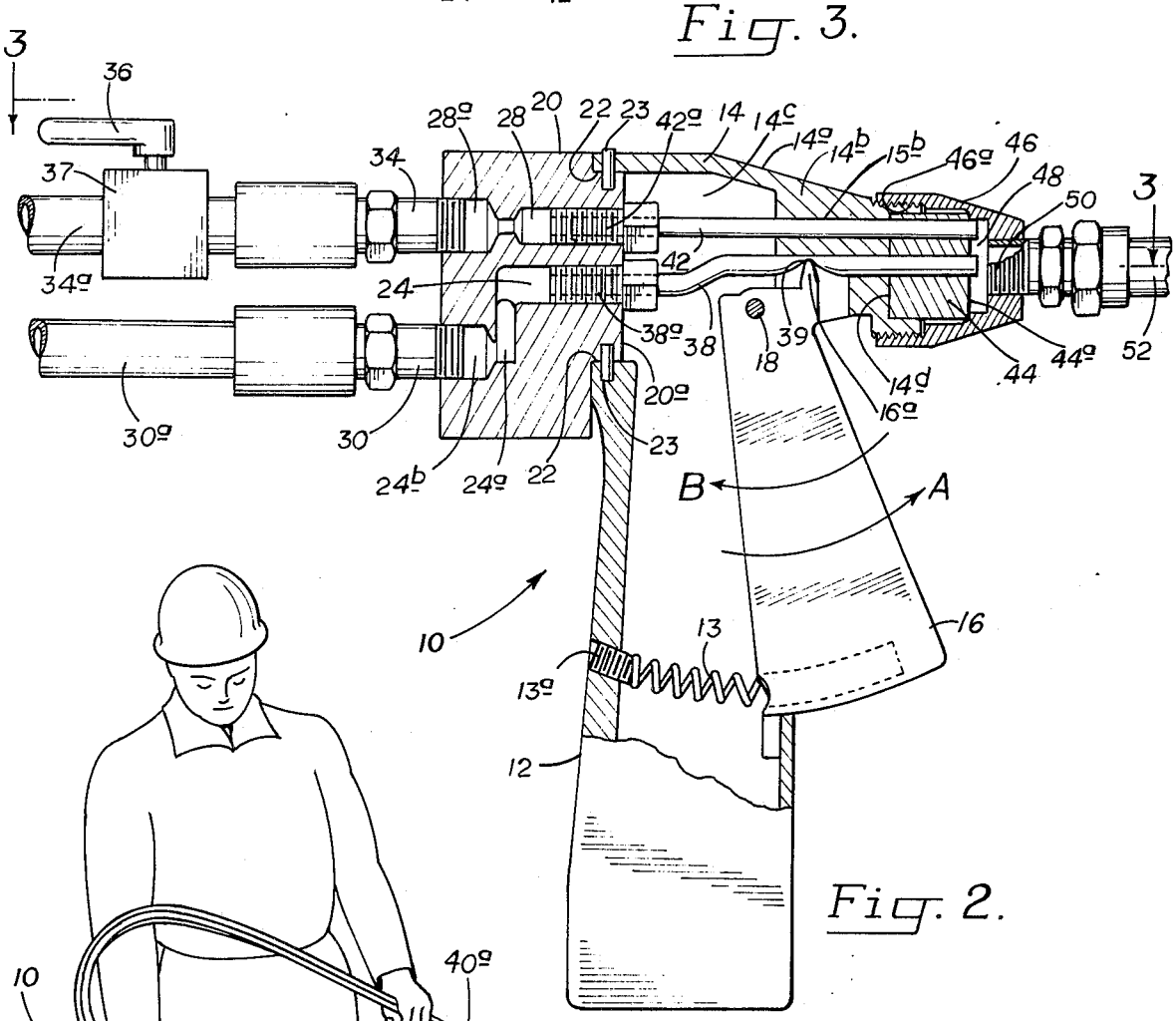
FIG. 2 is a cross-sectional view of the portable dispensing gun of the present invention.

With reference directed initially to FIGS. 2 and 3 of the drawings, features of the portable dispensing gun, generally designated at 10, may be appreciated. Dispensing gun 10 includes an elongate handle 12 which incorporates an upper barrel portion 14 connected thereto. Barrel portion 14 may be conveniently constructed with a conically shaped neck section 14*a*. Neck section 14*a* may further include a solid segment 14*b* having passages 15, 15*a* and 15*b* extending therethrough. Handle 12 includes a trigger lever 16 which is pivotally connected at 18. Trigger lever 16 further includes a member 16*a*, the purpose of which will be later described.

A head assembly 20 including a recessed portion 22 is arranged to engage barrel 14 at a rearward portion thereof. Pins 23 or other appropriate securing devices are used to detachably secure head assembly 20 to barrel portion 14. Head assembly 20 is provided with a plurality of passages 24, 26 and 28. Passages 24 and 26 are connected to passages 24*a*, 24*b* and 26*a*, 26*b*, respectively. Passages 24*b* and 26*b* are arranged to receive threaded fittings 30 and 32 which connect conduits or hoses 30*a* and 32*b* to fluid supply sources. A threaded fitting 34, connected to passage 28*a*, detachably secures conduit 34*a* to passage 28*a*. A valve 36, 37 is arranged on conduit 34*a* to permit or restrict fluid flow therethrough. An inner wall 20*a* of head assembly 20 is arranged to permit flexible tubes 38 and 40 to extend through cavity 14*c*. Flexible tubes 38, 40 are arranged in communication with passages 24 and 26 by means of threaded fittings 38*a* and 40*a*. Passage 28 communicates with tube 42 by means of threaded fitting 42*a*.

An orienting plug 44 is arranged so that tubes 38, 40 and 42 extend therethrough. Orienting plug 44 is disposed against a recessed wall surface 14*d* of solid portion 14*b*. A cap means such as cap nut 46, having a threaded portion 46*a* and an outlet 46*b*, is threadedly secured to solid section 14*b* to define a chamber 48 between a surface 44*a* of orienting block 44 and an internal wall 46*c* of the cap nut a a threaded fitting 50 is secured to an elongate conduit 52 which may incorporate further components for mixing fluidic materials.

OPERATION OF THE DISPENSING GUN

As shown in FIG. 2, trigger lever 16 is normally urged by biasing spring 13 in the direction of arrow A so that member 16*a* contacts and deforms tubes 38 and 40 as shown at 39. When it is desired to mix fluidic components, trigger lever 16 is moved against spring 13 in the direction of arrow B so that member 16*a* is released from a tube deforming position. Fluidic components may then travel under pressure through supply hoses 30*a* and 32*a* through head assembly 20 and tubes 38, 40 to initial mixing chamber 48. Here, the fluidic materials are initially mixed before being discharged through hollow threaded fitting 50 for eventual passage through mixing conduit 52. While complete mixing may not take place in initial mixing chamber 48, it is to be appreciated that a substantial amount of mixing will occur thus adding to the total efficiency of the mixing process. Valve 36, 37 is maintained in a closed position to prevent solvent from being transported through supply hose 34*a* when the fluidic materials are being mixed.

Figure 1:
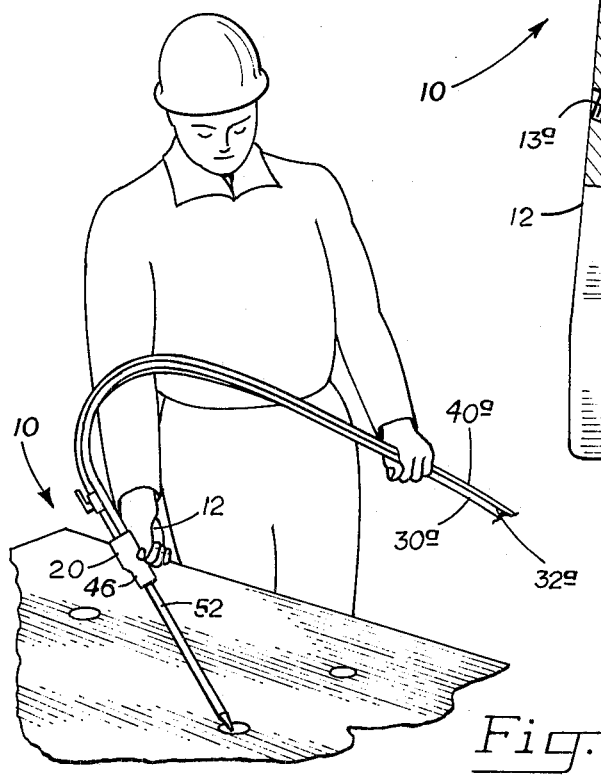
FIG. 1 is a general view showing an individual operating the dispensing gun of the present invention to apply a filling material to knotholes or other surface defects in a panel.

In the wood products industry, resin and catalyst may be comingled for discharge of such a mixture through dispensing gun 10 and mixing tube 52 by an individual, as shown in FIG. 1, to fill knotholes or other wood product defects. However, resin and catalyst set up or harden very quickly, and therefore it is imperative to provide a dispensing gun which will wash away as much residue as possible. Thus, after a predetermined amount of fluidic components have been discharged through tubes 38 and 40 sufficient to fill a specific knothole or other wood defect, trigger lever 16 is released to permit detent **16*a* to restrict passage of further fluidic components such as resin and catalyst through tubes 38, 40. Valve 36, 37 is then opened to permit a washing solvent to be channeled into chamber 48 and outwardly through conduit 52**. Thus, it is an apparent advantage of the present invention that fluidic materials which set or harden quickly may be prevented from jamming or clogging the dispensing gun by providing a solvent cleaning tube.

Because member **16*a* frictionally engages and deforms tubes 38, 40, it may become necessary to replace the tubes after prolonged use. Also, the tubes may become somewhat fouled due to a building up of residue on the inside of the tubes. If it is desired to replace any or all of tubes 38, 40 and 42, or to clean same, dispensing gun 10 may be readily disassembled. For instance, pins 23 or other similar locking devices are removed so that head assembly 20 may be disunited from barrel 14. The tubes slide outwardly from solid portion 14*b* and orienting plug 44 through passages 15, 15*a* and 15*b*. With head assembly 20 separated from dispensing gun 10, threaded fittings 38*a*, 42*a* and 44*a* may be removed and tubes 38, 40 and 42 may be replaced or cleaned. Furthermore, it is to be noted that cap nut 46 may be disengaged from solid portion 14*b* so that initial mixing chamber 48** may also be cleaned.

While the above invention has been described with only two tubes for mixing fluidic components, it is apparent that any number practicable may be used as is needed for a given application. Furthermore, while the invention has been particularly shown and described with reference to the foregoing preferred embodiment thereof, it will be understood by those skilled in the art that other changes in form and detail may be made therein without departing from the spirit and scope of the invention as defined in the appended claims.

What is claimed is:

1. A portable, hand-held, readily disassemblable fluid dispensing gun for introducing fluidic materials from a supply source to a mixing conduit or the like comprising:

a handle including a barrel;

a head assembly detachably connected to a rear end of said barrel, said head assembly having plural fluid conducting passages extending therethrough;

a plurality of flexible, fluid conducting tubes each being detachably connected to said head assembly and communicating with an associated one of said passages, said tubes extending from said head assembly through said barrel and outwardly from a front end of said barrel, said tubes being detachable from said head assembly when said assembly is separated from said barrel;

a trigger lever having a member extending from one end thereof, said lever being mounted on said handle and normally biased to a position in which said member deforms said tubes, said lever also being selectively movable to a position in which said tubes are nondeformed by said member;

A removable orienting plug mounted against said front end of said barrel including passages for receiving said fluid conducting tubes which extend therethrough; and cap means detachably connected to said front end including an outlet, said cap means urging said orienting plug against said front end and providing an internal wall of an initial mixing chamber adjacent said front end, said cap means also providing a mounting for said mixing conduit extending outwardly therefrom.

2. A fluid dispensing gun as defined in claim 1, wherein an additional fluid transporting tube is arranged above said plurality of tubes, said additional tube communicating with an additional passage in said head assembly for delivering a metered amount of solvent or the like from a source to said initial mixing chamber.

3. A fluid dispensing gun as defined in claim 1 wherein a first face of said orienting plug is arranged to seat within a recess formed in the front end of said barrel, a second face of said orienting plug providing a wall of said initial mixing chamber.

* * * * *